US006135423A

United States Patent [19]

Johnson

[11] Patent Number: 6,135,423

[45] Date of Patent: Oct. 24, 2000

[54] CART SIGN AND/OR BARRIER

[75] Inventor: Mike Johnson, Bentonville, Ark.

[73] Assignee: Barbara Johnson, Bentonville, Ark.

[21] Appl. No.: 09/340,118

[22] Filed: Jun. 28, 1999

[51] Int. Cl.[7] ..... E04H 17/00

[52] U.S. Cl. ..... 256/1; 280/33.992

[58] Field of Search ..... 256/1, 24, 13.1, 256/25–26; 40/308, 515, 610; 280/33.992, DIG. 4; 160/24; 49/34; 116/638

[56] References Cited

U.S. PATENT DOCUMENTS

| | | | |
|---|---|---|---|
| 2,887,983 | 5/1959 | Budd | 116/63 |
| 3,200,786 | 8/1965 | Swezy et al. | 116/63 |
| 3,223,387 | 12/1965 | Magliocco | 256/59 |
| 3,291,096 | 12/1966 | Walter | 116/63 |
| 3,777,428 | 12/1973 | Caufield | 52/146 |
| 3,917,231 | 11/1975 | Fink | 256/1 X |
| 4,055,840 | 10/1977 | Uchytil et al. | 340/321 |
| 4,124,196 | 11/1978 | Hipskind | 256/1 |
| 4,209,928 | 7/1980 | Kraayvanger | 40/610 |
| 4,256,050 | 3/1981 | Barnard | 116/63 C |
| 4,455,697 | 6/1984 | Rovida | 256/25 X |
| 4,524,953 | 6/1985 | Phillips et al. | 256/1 X |
| 4,817,318 | 4/1989 | Strauch | 40/610 |
| 4,844,420 | 7/1989 | Oster | 256/1 |
| 4,848,263 | 7/1989 | Grimm | 116/63 C |
| 4,968,177 | 11/1990 | Bechtold | 256/13.1 X |
| 5,050,846 | 9/1991 | Goodman et al. | 256/1 |
| 5,199,375 | 4/1993 | Johnson | 116/209 |
| 5,271,634 | 12/1993 | Walton | 280/33.992 |
| 5,322,306 | 6/1994 | Coleman | 280/33.992 |
| 5,439,253 | 8/1995 | Trubiano | 280/DIG. 4 X |
| 5,660,144 | 8/1997 | Venti | 256/1 X |

FOREIGN PATENT DOCUMENTS

| | | |
|---|---|---|
| 1188988 | 3/1965 | Germany . |
| 1395169 | 5/1975 | United Kingdom . |

*Primary Examiner*—Harry C. Kim
*Attorney, Agent, or Firm*—Aquilino, Welsh & Flaxman

[57] ABSTRACT

A portable barrier in combination with a shopping cart is disclosed. The combination includes a shopping cart having a base supporting a basket adapted for temporarily carrier goods and a plurality of wheels secured to the base facilitating easy movement of the shopping cart and a barrier secured to the shopping cart for selective use in creating a ready barrier.

16 Claims, 3 Drawing Sheets

CART SIGN AND/OR BARRIER

BACKGROUND OF THE INVENTION

1. Field of the Invention

The invention relates to a portable sign and/or barrier. More particularly, the invention relates to a portable sign and/or barrier secured to a conventional shopping cart. For the sake of brevity the present invention will be referred to as a cart barrier throughout the body of the following specification, although it should be readily understood that the present invention may be used simply as a sign without departing from the spirit of the present invention.

2. Description of the Prior Art

Stores, and especially grocery stores, are continually confronted with the need to create barriers to keep costumers from entering hazardous areas. For example, when a spill occurs in the aisle of a grocery store, an employee must leave the aisle to gather the equipment necessary for cleaning the mess. If a barrier is not readily available, the aisle must be left unprotected while the employee goes to gather the necessary equipment to clean up the spill.

This often presents danger to those patronizing the store, and costs stores substantial damages in slip and fall lawsuits. For example, the average "slip and fall" will cost a store approximately $7,500. Other slip and falls may cost a store up to hundreds of thousands of the dollars if not more.

As a result, a need exists for a portable and readily available barrier which may be used to protect consumers from dangerous situations which may arise while shopping in a retail store. The present invention provides such a barrier.

SUMMARY OF THE INVENTION

It is, therefore, an object of the present invention to provide a portable barrier in combination with a shopping cart. The combination includes a shopping cart having a base supporting a basket adapted for temporarily carrying goods and a plurality of wheels secured to the base facilitating easy movement of the shopping cart and a portable barrier secured to the shopping cart for selective use in creating a ready barrier.

It is also an object of the present invention to provide a portable barrier secured to the base of the shopping cart.

It is another object of the present invention to provide a portable barrier selectively secured to the shopping cart.

It is a further object of the present invention to provide a portable barrier including a housing supporting a retractable barrier member.

It is also an object of the present invention to provide a portable barrier wherein the barrier member includes a free first end and a second end coupled to the housing, and the first end of the barrier member includes a connecting member which may be attached to an adjacent support to create an extended barrier.

It is another object of the present invention to provide a portable barrier wherein the connecting member is hook and loop type fastening material.

It is a further object of the present invention to provide a portable barrier wherein the barrier member is a barrier tape.

It is also an object of the present invention to provide a portable barrier wherein the barrier member includes a first barrier tape and a second barrier tape.

It is another object of the present invention to provide a portable barrier wherein the barrier tape is resilient biased such that it selectively retracts into the housing.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
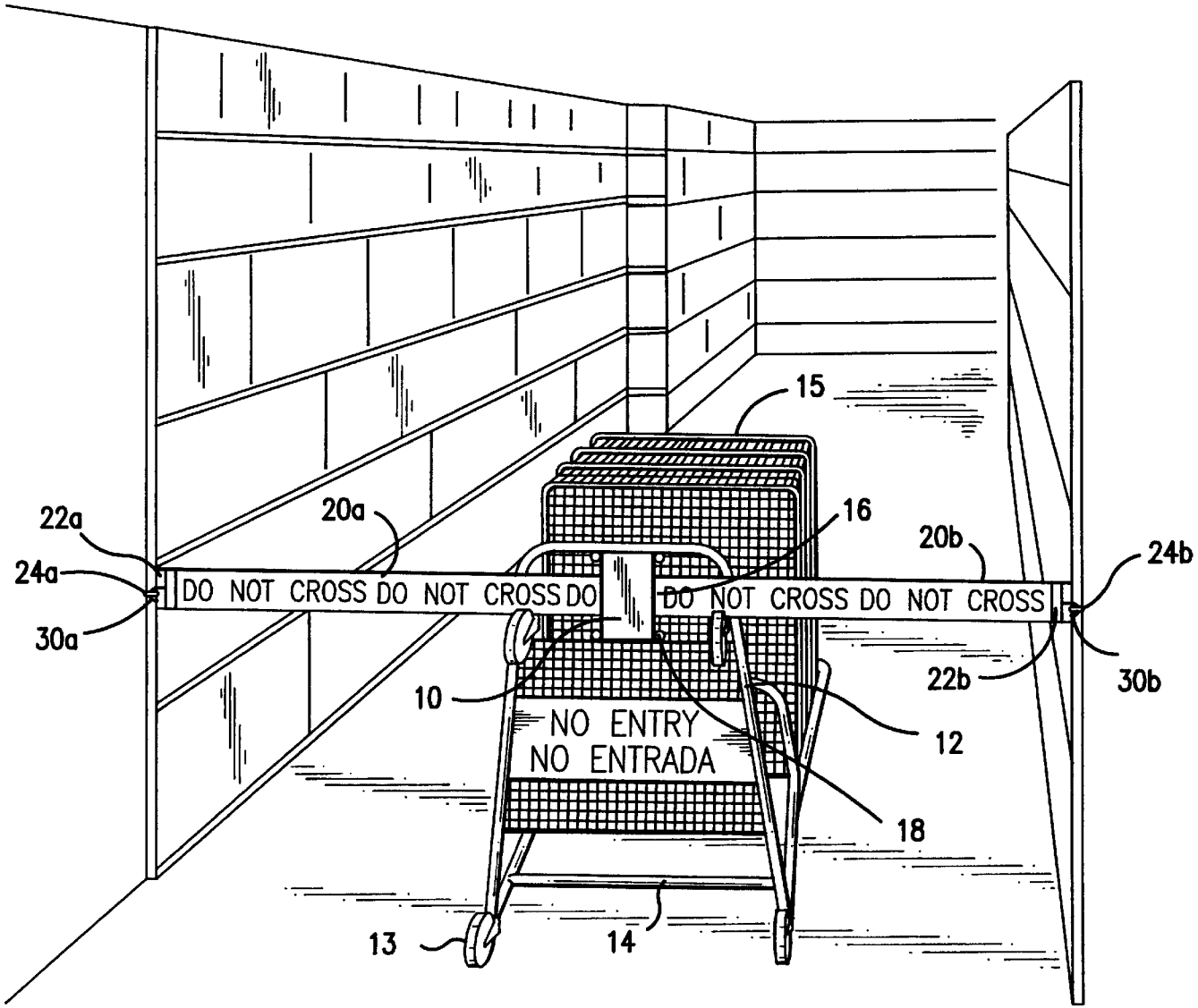
FIG. 1 is a perspective view of the cart barrier in use.
Figure 2:
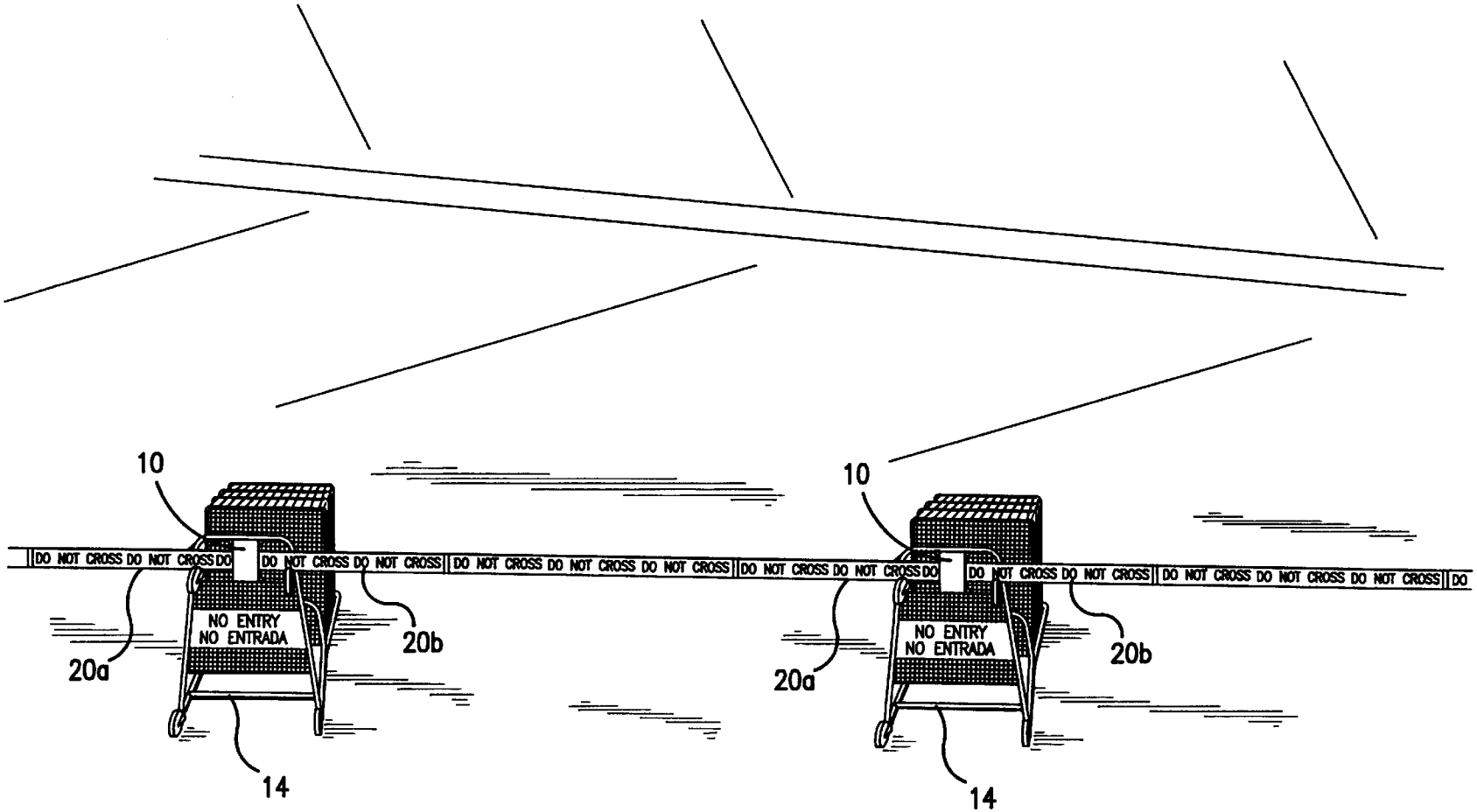
FIG. 2 is a perspective view of the cart barrier used for a different application.

With reference to FIG. 1 and 2, a cart barrier 10 in accordance with the present invention is disclosed. As discussed above, many accidents occur in stores when a dangerous spill is left unattended. However, before the spill may be cleaned, an employee must leave the spill site and obtain the necessary tools to clean the spill. The present cart barrier 10 allows the employee to readily and conveniently create a barrier about the spill site before leaving to gather the necessary tools.

The present cart barrier 10 is secured to the base 12 of a conventional shopping cart 14 and permits an employee to quickly set up an effective barrier in a matter of minutes. The shopping cart 14 includes wheels 13 and a basket 15 which are coupled to the base 12. Since shopping carts 14 are almost always readily available at stores, and particularly at grocery stores, the employee will not have to look far to find a shopping cart.

With reference to FIG. 1, the cart barrier 10 includes a housing 16 which is readily secured to the base 12 of a conventional shopping cart 14. While FIG. 1 shows the cart barrier 10 coupled to the base 12 of a specific type of shopping cart 14, the cart barrier 10 may be readily adapted for attachment to a variety of shopping carts without departing from the spirit of the invention.

The housing 16 of the cart barrier is preferably secured to the base 12 of the shopping cart 14 with tensioning clamps 18. In accordance with the preferred embodiment of the present invention, four tensioning clamps 18 are employed, although other securing structures may be used without departing from the spirit of the present invention. The clamps 18 are moved by turning a screw that lengthens or shortens the distance between the opposite clamps.

First and second resiliently biased, self-contained barrier tapes 20*a*, 20*b* are stored within the housing 16 of the cart barrier. The tapes 20*a*, 20*b* are conventional resiliently biased barrier tapes which may be drawn from the housing 16 to create an effective barrier. As those of ordinary skill in the art will readily appreciate, the free end 22*a*, 22*b* of the barrier tape 20*a*, 20*b* is withdrawn from the housing 16 and coupled to an adjacent structure, via a connecting member

24*a*, 24*b* secured to the free end 22*a*, 22*b* of the tape 20*a*, 20*b*, to create a barrier. For example, U.S. Pat. No. 4,844, 420, to Oster, entitled "Retractable Crowd Control Barrier", discloses a resiliently biased barrier tape which may be used in accordance with the present invention. The '420 patent is incorporated herein by reference.

Figure 3:
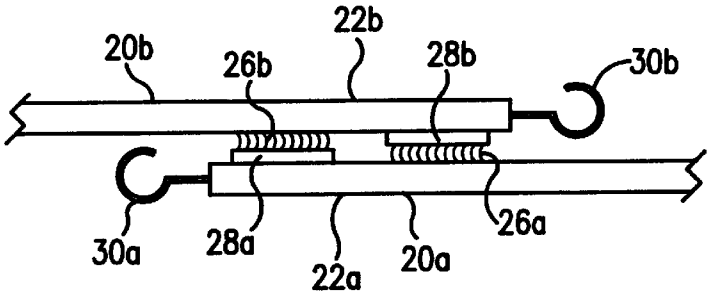
FIG. 3 is a cross sectional view of first and second barrier tapes secured together.

In accordance with the preferred embodiment of the present invention, and with reference to FIG. 3, the connecting member 24*a*, 24*b* is composed of adjacent hook and loop type materials 26*a*, 26*b*, 28*a*, 28*b* respectively provided on the free end 22*a*, 22*b* of the tape 20*a*, 20*b*. The free ends 22*a*, 22*b* of the barrier tapes 20*a*, 20*b* are each also provided with a small plastic hook 30*a*, 30*b* to facilitate attachment to shelving.

In use, the shopping cart 14 is first flipped backward as shown in FIGS. 1 and 2. Once the shopping cart is properly positioned, the free ends 22*a*, 22*b* of the first and second barrier tapes 20*a*, 20*b* are withdrawn from the housing 16 and coupled to adjacent structures to create a barrier. Multiple shopping carts 14 may be positioned about a predetermined area to create a barrier thereabout as shown in FIG. 2. When the site no longer is dangerous, the barrier tapes 20*a*, 20*b* are released from the adjacent structures and the resilient bias draws them back into the housing 16.

The barrier tape 20*a*, 20*b* used in accordance with the present invention, may include written warnings when it is retracted from the housing 16. For example, the tape 20*a*, 20*b* may state "NO ENTRY, NO ENTRADA", "WET FLOOR" OR "KEEP OUT". In addition, the tape 20*a*, 20*b* may be made in bright colors and may include blinking LED lights or reflective materials.

Figure 5:
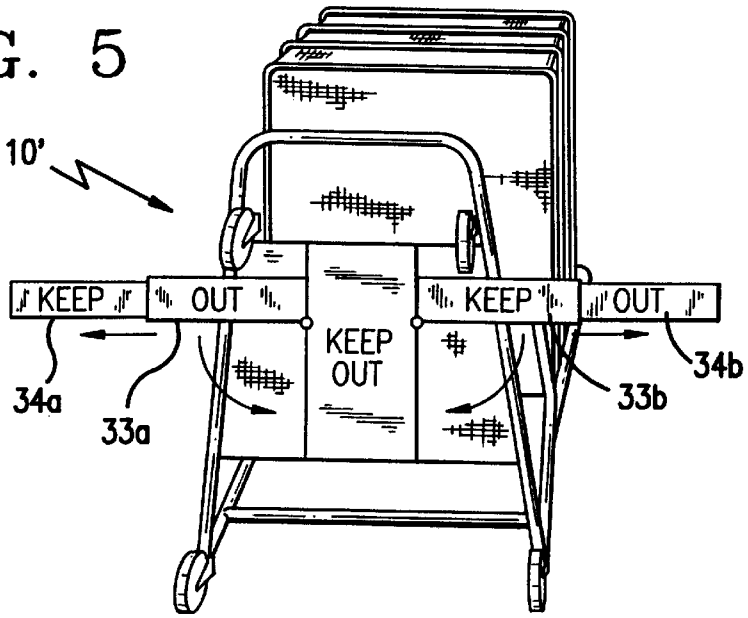
FIGS. 4 and 5 disclose an alternate barrier structure for use with the present invention.
Figure 4:
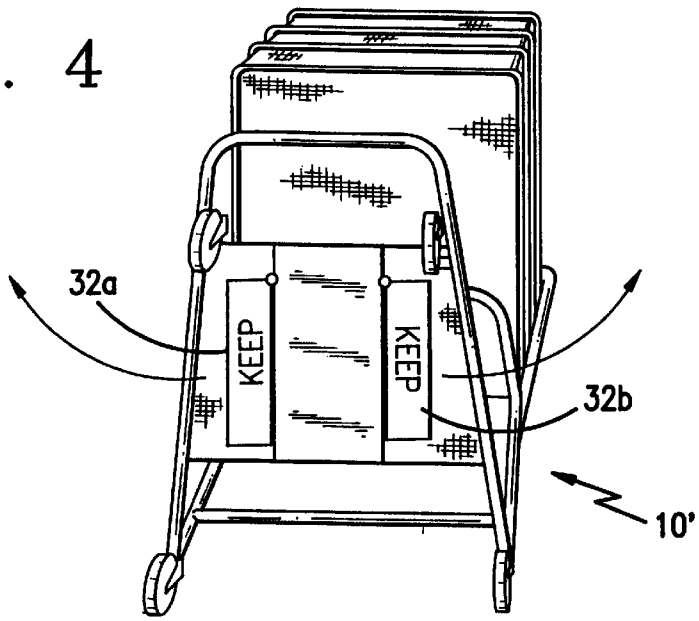

An alternate embodiment of the cart sign 10' disclosed above is shown in FIGS. 4 and 5. The alternate embodiment is substantially identical to the prior cart sign, but replaces the barrier tape with a pair of wings 32*a*, 32*b* which fold out to create the desire barrier. Each wing 32*a*, 32*b* includes a base member 33*a*, 33*b* pivotally coupled to the housing and a telescoping member 34*a*, 34*b* telescopically extending from the base member 33*a*, 33*b*. As such, the wings 32*a*, 32*b* are placed into use by pivoting the base members 33*a*, 33*b* outwardly and extending the telescoping member 34*a*, 34*b*. In this way, the wings 32*a*, 32*b* are extended to create the desired barrier.

The present cart barrier provides a convenient and adaptable barrier which is large and mobile. Since the cart barrier is secured to shopping carts, the cart barriers are readily available throughout the store, ensuring fast and effective creation of warnings and barricades.

The present cart barrier is not only designed for use within grocery stores but may be employed by all retailers using shopping carts. For example, the cart barrier may be used to close off an aisle when it is time for the aisle to be stripped and resurfaced. The cart barrier may also be used to create barricades when forklifts and stackers are in use. In fact, the present cart sign may be used to create a barrier at any location a retailer deems appropriate.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A portable barrier in combination with a shopping cart, comprising:

a shopping cart including a base supporting a basket adapted for temporarily carrying goods and a plurality of wheels secured to the base facilitating easy movement of the shopping cart; and a portable barrier secured to the base of the shopping cart for selective use in creating a ready barrier.

2. The portable barrier/shopping cart according to claim 1, wherein the portable barrier is selectively secured to the shopping cart.

3. The portable barrier/shopping cart according to claim 1, wherein the portable barrier includes a housing supporting a retractable barrier member.

4. The portable barrier/shopping cart according to claim 3, wherein the barrier member includes a free first end and a second end coupled to the housing, and the first end of the barrier member includes a connecting member which may be attached to an adjacent support to create an extended barrier.

5. The portable barrier/shopping cart according to claim 4, wherein the connecting member is of a hook and loop type fastener.

6. The portable barrier/shopping cart according to claim 3, wherein the barrier member is a barrier tape.

7. The portable barrier/shopping cart according to claim 6, wherein the barrier tape is resiliently biased such that it selectively retracts into the housing.

8. The portable barrier/shopping cart according to claim 3, wherein the barrier member is composed of a first barrier tape and a second barrier tape.

9. The portable barrier/shopping cart according to claim 3, wherein the barrier member is a telescopic and foldable wing.

10. A portable barrier, comprising:

a housing including a coupling means for attaching the portable barrier to a base of a shopping cart wherein the base supports a basket and includes a plurality of wheels secured thereto; and a barrier member supported by the housing, the barrier member including a first retractable barrier and a second retractable barrier which are selectively drawn from the housing to readily create a barrier.

11. The portable barrier according to claim 10, wherein the barrier member is stored with the housing.

12. The portable barrier according to claim 11, wherein the first retractable barrier includes a free first end and a second end coupled to the housing, and the first end of the first retractable barrier includes a connecting member which may be attached to an adjacent support to create a desired barrier; and the second retractable barrier includes a free first end and a second end coupled to the housing, and the first end of the second retractable barrier includes a connecting member which may be attached to an adjacent support to create a desired barrier.

13. The portable barrier according to claim 12, wherein the connecting members are hook and loop type fasteners.

14. The portable barrier according to claim 10, wherein the first and second retractable barriers are respectively a first barrier tape and a second barrier tape.

15. The portable barrier according to claim 14, wherein the first and second barrier tapes are resiliently biased such that they selectively retract into the housing.

16. The portable barrier according to claim 10, wherein the first and second retractable barriers are respectively a first telescopic and foldable wing and a second telescopic and foldable wing.

* * * * *